US009371612B2

(12) United States Patent
Leavitt et al.

(10) Patent No.: US 9,371,612 B2
(45) Date of Patent: Jun. 21, 2016

(54) METHOD AND APPARATUS TO PRODUCE PULP USING PRE-HYDROLYSIS AND KRAFT COOKING

(75) Inventors: Aaron Leavitt, Alpharetta, GA (US); Jussi Pakarinen, Kotka (FI); Brian F. Greenwood, Cumming, GA (US)

(73) Assignee: ANDRITZ INC., Glens Falls, NY (US)

( * ) Notice: Subject to any disclaimer, the term of this patent is extended or adjusted under 35 U.S.C. 154(b) by 0 days.

(21) Appl. No.: 13/363,680

(22) Filed: Feb. 1, 2012

(65) Prior Publication Data

US 2012/0211183 A1 Aug. 23, 2012

Related U.S. Application Data

(60) Provisional application No. 61/445,253, filed on Feb. 22, 2011.

(51) Int. Cl.

| | |
|---|---|
| ***D21C 1/04*** | (2006.01) |
| *D21C 3/02* | (2006.01) |
| *D21C 3/24* | (2006.01) |

(52) U.S. Cl.

CPC .. *D21C 1/04* (2013.01); *D21C 3/02* (2013.01); *D21C 3/24* (2013.01)

(58) Field of Classification Search

USPC ..... 162/37

See application file for complete search history.

(56) References Cited

U.S. PATENT DOCUMENTS

| | | | | |
|---|---|---|---|---|
| 2,988,470 | A * | 6/1961 | Bradway et al. | 162/17 |
| 4,436,586 | A * | 3/1984 | Elmore | 162/19 |
| 4,456,750 | A | 6/1984 | Marttala et al. | |
| 4,668,340 | A * | 5/1987 | Sherman | 162/16 |
| 6,533,896 | B1 * | 3/2003 | Tikka et al. | 162/19 |
| 2008/0302492 | A1 * | 12/2008 | Shin et al. | 162/19 |
| 2009/0218055 | A1 * | 9/2009 | Uusitalo et al. | 162/60 |

FOREIGN PATENT DOCUMENTS

| | | |
|---|---|---|
| WO | 95/20065 | 7/1995 |
| WO | 2007/065241 | 6/2007 |
| WO | 2007/090926 | 8/2007 |

OTHER PUBLICATIONS

European Search Report mailed Jul. 13, 2012.

* cited by examiner

*Primary Examiner* — Jacob Thomas Minskey
(74) *Attorney, Agent, or Firm* — Nixon & Vanderhye P.C.

(57) ABSTRACT

A pulp cooking system including: a cellulosic material feed system, a pre-hydrolysis reactor vessel and a Kraft cooking reactor vessel. The feed material system includes a steaming chip bin and a high pressure transfer device. The pre-hydrolysis reactor vessel maintains the feed material in a mildly acidic condition and allows hydrolysate to be extracted through screens below a hydrolysis zone in the vessel. A wash zone is below the screens and allows wash liquid to flow through the feed material in a cross-current direction. The wash liquid and hydrolysate removed from the feed material is extracted through the screens. The feed material is maintained in a mildly acidic condition through the pre-hydrolysis reactor vessel until the material enters the Kraft cooking vessel where the feed material is treated with alkaline cooking liquors.

25 Claims, 2 Drawing Sheets

METHOD AND APPARATUS TO PRODUCE PULP USING PRE-HYDROLYSIS AND KRAFT COOKING

CROSS RELATED APPLICATION

This application claims the benefit of U.S. provisional application Ser. No. 61/445,253 filed Feb. 22, 2011, which is incorporated in its entirety by reference.

BACKGROUND OF THE INVENTION

This invention relates generally to dissolving pulp by cooking and particularly with pre-hydrolysis and Kraft cooking of wood chips Hydrolysis of comminuted cellulosic fiber feed material, such as wood chips, before Kraft cooking is describe in U.S. Pat. Nos. 3,3380,883 and 4,436,586, and in Blom et al, "Development of the Alva Prehydrolysis Process, Part Two: Mill Scale Application," pp. 409-416 TAPPI Proceedings, 1981 Pulping Conference. Prehydrolysis is typically used to dissolve pulp for use in forming rayon or plastics.

The pseudolignins formed during hydrolysis of wood can coat wood chips and the surfaces of the reactor and other equipment exposed to the hydrolyzed cellulosic fiber feed material. The pseudolignins are formed through recondensation and polymerization of reactive byproducts from the hydrolysis of the cellulosic fiber feed material. These reactive components include dissolved hemicellulose and other wood compounds. Fragments of lignin that dissolve in hydrolysis can also coat the wood chips and the surfaces of the pre-hydrolysis reactor and other equipment. The pseudolignins and lignin fragments tend to build up on the surfaces of chips and equipment most when in an acidic environments; such as typically exists in pre-hydrolysis. The dissolved complex organic molecules in the pseudolignins and dissolved lignins may coat the chips and block pores in the chips. The pores should be open to allow penetration of alkali during the Kraft stage of the process. Buildups of pseudolignins and dissolved lignins on equipment can block the flow passages for the cellulosic feed material, interfere with rotation of moving parts and otherwise interfere with the operation of equipment.

SUMMARY OF THE INVENTION

Methods and systems for dissolving pulp cooking have been conceived that reduce the buildup of pseudolignins and lignin fragments on wood chips and equipment and enhance the control of the flow of feed material through pre-hydrolysis and Kraft cooking reactors.

The pulp cooking system includes a pre-hydrolysis vessel and transfer system having multiple extraction points to remove the products of hydrolysis as the products are formed in the vessel and transfer system. Fresh wash liquids, such as water, may be added at various locations in the vessel and transfer system. By way of example, a center pipe, extending vertically into the pre-hydrolysis vessel, discharges water or a wash liquid into the downward flow of cellulosic feed material through the vessel. Extraction screens arranged at one or more elevations on the pre-hydrolysis vessel extract the pseudolignins as they are formed in the vessel. In the transfer system, extraction points may be provided using an in-line drainer. Wash liquid is added through dilution nozzles arranged at one or more locations in the material feed flow through the transfer system.

The chip feed device for the pulp cooking system can be a chip bin having converging sides, such as the Diamondback® chip bin sold by the Andritz Group, and steam injection to heat the feed material. A chip pump system, such as the TurboFeed® system sold by the Andritz Group, provides a stable and precise volume of feed material to the pre-hydrolysis reactor.

Lowering the pH of the cellulosic feed material, e.g., wood chips, moving through the chip feed and transfer devices may accelerate the start of the hydrolysis reaction. An approach to lowering the pH is to add hydrolysate extracted from the lower portions of the pre-hydrolysis reactor to the feed material in one or more of the chip feed, transfer system and the upper regions of the reactor. The hydrolysate in the lower portion of the pre-hydrolysis reactor has a relatively low pH and can be used to lower the pH of the feed material in the upstream portions of the vessel and feed and transfer devices.

Wash water and filtrate liquid tend to have different pH levels than the feed material. Wash water and filtrate liquid may be added to the chip feed and transfer devices to adjust to the pH and adjust the relative the liquor to wood ratio of the feed material in the chip feed and transport devices and the upper regions of the pre-hydrolysis reactor. Heat may be recovered from the hydrolysate extracted in the pre-hydrolysis reactor to heat wash water and filtrate to be added to the pre-hydrolysis vessel.

The pH level of the feed material in the pre-hydrolysis reactor may be managed, e.g., reduced, by adding wash water, low pH hydrolysate and filtrate at one or more elevations of the reactor. The low pH hydrolysate may be extracted from lower elevations in the reactor and circulated back into the reactor at an upper region of the reactor. In-vessel circulation loops and a central pipe discharge having one or more elevations at which fluid is discharged may be used to controllably added low pH liquid to the reactor.

The wash zone(s) in the lower portion of the vessel may have wash liquid flow in counter-current or con-current directions to the downward flow of the feed material in the pre-hydrolysis reactor vessel. If the injection of wash liquid has a neutral pH, mild alkaline or a pH that is less acidic than the pH in the hydrolysis zone, the wash liquid will tend to reduce acidity of the feed material in the lower region of the pre-hydrolysis reactor. The wash liquid may have an alkaline pH, especially if the wash water is mixed with brown stock filtrate or sodium hydroxide and used in a counter-current or a displacement wash zone in a lower elevation of the pre-hydrolysis reactor.

The wash liquid may also be fortified with a bisulfite compound or other additive. The fortified wash liquid may be used in a counter-current or displacement wash zone in a lower elevation of the pre-hydrolysis reactor. The addition of a bisulfite compound or other additive to the wash liquid may reduce the tendency of the dissolved lignin or pseudo-lignin in the wash zone of the pre-hydrolysis reactor and transfer devices to precipitate on the surfaces of the chips and equipment.

The pH of the chip feed material being discharged from the bottom of the pre-hydrolysis reactor may be controlled, e.g., lowered or increased, by adding pH adjusted wash water/filtrate through a nozzle at the bottom of the vessel. The amount of buildup of pseudolignins and lignin deposits may be reduced by controlling the pH of the feed material, such as by maintaining acidic levels at a uniform level as the feed material flows through the chip feed and transport devices, the pre-hydrolysis reactor and the transport conduits from the pre-hydrolysis reactor to a Kraft digester. The desired pH level for the feed material may be predetermined based on the type of feed material, pressure and temperature in the prehydrolysis reactor and other conditions. A person of ordinary skill in the chemistry and operation of Kraft pulping systems will understand how to determine the desired pH level of the chip feed material.

The transfer liquid may also be fortified with a bisulfite compound or other additive(s) before being added to the feed material at or near the discharge of the pre-hydrolysis reactor vessel. The bisulfite compound or other additive may be selected to reduce the tendency of the dissolved lignin or pseudolignin to precipitate on the surfaces of the chips and transfer devices.

As the feed material enters the Kraft digester, such as through an inverted top separator, in one mode of operation, the feed material remains acidic with no high pH regions until the chips of the feed material enter the digester vessel. White liquor (such as, sodium hydroxide and sodium sulfide solution) may be added to the feed material in the top separator or sprayed into the top of the digester vessel. In another mode of operation, white liquor may be added to the transfer circulation and the chips raised to a high pH during the transfer between vessels.

A method has been conceived to produce pulp using a feed system, a prehydrolysis reactor vessel and Kraft cooking vessel including: steaming cellulosic fibrous organic feed material in a material feed system; adding to the feed material wash filtrate extracted from the prehydrolysis reactor vessel before the feed material enters the prehydrolysis reactor vessel; pressurizing the feed material from the chip feed system in a high pressure transfer device before the feed material enters the prehydrolysis vessel; transferring the pressurized feed material to an upper inlet to the prehydrolysis reactor vessel; subjecting the feed material to a hydrolysis reaction in an hydrolysis zone in the prehydrolysis reactor vessel, wherein hydrolysate is a byproduct generated by the hydrolysis reaction; extracting the hydrolysate with the wash filtrate extracted through a screen in the prehydrolysis reactor vessel, wherein the screen is adjacent a lower portion of the hydrolysis zone; adding a wash liquid to a lower region of a wash zone in the prehydrolysis reactor vessel; as the feed material flows downward past the screen and through the wash zone, washing the feed material with the wash liquid flowing upward through the wash zone to the screen; discharging the washed feed material from the prehydrolysis reactor vessel and transporting the washed feed material to an upper inlet to the Kraft cooking vessel; changing the pH of the washed feed material to alkaline after the feed material is in the Kraft cooking vessel, and effecting Kraft cooking of the washed feed material in the Kraft cooking vessel to produce the pulp.

A method has been conceived to produce pulp using a feed system, a prehydrolysis reactor vessel and Kraft cooking vessel, the method comprising: steaming cellulosic fibrous organic feed material in a material feed system; adding to the feed material wash filtrate extracted from the prehydrolysis reactor vessel before the feed material enters the prehydrolysis reactor vessel; pressurizing the feed material from the chip feed system in a high pressure transfer device before the feed material enters the prehydrolysis vessel and transferring the pressurized feed material to an upper inlet to the prehydrolysis reactor vessel; subjecting the feed material to a hydrolysis reaction in a hydrolysis zone in the prehydrolysis reactor vessel, wherein hydrolysate is generated by the hydrolysis reaction; extracting the hydrolysate through a screen in the prehydrolysis reactor vessel, wherein the screen is adjacent a lower portion of the hydrolysis zone; adding a wash liquid to a wash zone in the prehydrolysis reactor vessel; as the feed material flows downward past the screen and through the wash zone, washing the feed material with the wash liquid flowing upward through the wash zone to the screen; discharging the washed feed material from the prehydrolysis reactor vessel and transporting the washed feed material to an upper inlet to the Kraft cooking vessel; and changing the pH of the washed feed material to alkaline after the feed material is in the Kraft cooking vessel, and Kraft cooking the washed feed material in the Kraft cooking vessel to produce the pulp. The steps of the method may be performed contentiously and simultaneously as the feed material flows through the feed system, prehydrolysis reactor vessel and Kraft cooking vessel.

The pulp may be discharged from the Kraft cooking vessel to a blow tank and from the blow tank to a brown stock washer. The step of pressurizing the feed material includes pumping the feed material through at least one centrifugal pump, which comprises the high pressure transfer device.

The step of adding the wash liquid may include injecting the wash liquid from a center pipe coaxial to the prehydrolysis reactor vessel and having a discharge port at the lower region of the wash zone.

The hydrolysis reaction may be an autohydrolysis reaction and a temperature in the feed material is between 150 degrees and 160 degrees Celsius or between 140 degrees and 175 degrees Celsius. The pH of the pressurized feed material in the hydrolysis zone may be maintained at a pH of between 3 and 5 or at 4. The wash liquid may enter the wash zone at a temperature at least 10 degrees Celsius below a hydrolysis temperature in the hydrolysis zone and the wash liquid may include a bisulfite compound.

The wash filtrate or liquor extracted from a first elevation of the prehydrolysis reactor vessel may be reintroduced to the prehydrolysis reactor vessel at a second elevation which is above the first elevation. Alkaline white liquor is added to the feed material as the feed material is in an upper region of the Kraft cooking vessel.

A method has been conceived for pulping a comminuted cellulosic fibrous organic feed material in a feed system, a prehydrolysis reactor vessel and Kraft cooking vessel, the method comprising: steaming and adding wash filtrate to the feed material as the feed material flows continuously through the material feed system; pressurizing the feed material flowing from the chip feed system in a high pressure transfer device; moving the pressurized feed material into the prehydrolysis reactor vessel; subjecting the feed material to a hydrolysis reaction in a hydrolysis zone in the prehydrolysis reactor vessel; extracting hydrolysate formed in the hydrolysis zone and the wash filtrate through a screen proximate to a lower region of the hydrolysis zone in the prehydrolysis reactor vessel; adding a wash liquid to a wash zone in the prehydrolysis reactor vessel, wherein the wash zone is below the hydrolysis zone in the prehydrolysis reactor; moving the feed material continually downward through the hydrolysis zone and the wash zone of the prehydrolysis reactor vessel; moving the wash liquid continually upward through the wash zone to the screen; discharging the feed material from a lower outlet of the prehydrolysis reactor vessel, wherein the lower outlet proximate to a bottom of the wash zone; moving the discharged feed material into the Kraft cooking vessel; and adjusting the pH of the discharged feed material to alkaline while the feed material is in the Kraft cooking vessel, and Kraft cooking the feed material in the Kraft cooking vessel to produce pulp.

A system has been conceived to produce pulp from cellulosic fibrous organic feed material: a material feed system having an inlet to receive the feed material, a steam inlet to receive steam to be injected into the feed material in the feed system, a filtrate inlet and an outlet for the feed material; a high pressure transfer device including an inlet in fluid communication with the outlet of the material feed system; a prehydrolysis reactor vessel having a high pressure inlet in fluid communication with a high pressure outlet of the high pressure transfer device, wherein the prehydrolysis reactor includes an interior maintained at a temperature and pressure to promote hydrolysis of the feed material in the reactor; an extraction screen in a lower portion of the prehydrolysis reactor including a filter screen adjacent the interior of the prehydrolysis and a filtrate outlet on a side of the filter screen opposite to the interior, wherein the filtrate outlet is coupled to the filtrate inlet of the material feed system such that filtrate from the prehydrolysis reactor flows to the filtrate inlet, and a Kraft cooking vessel having a high pressure inlet coupled to a feed material high pressure discharge outlet of the prehydrolysis reactor such that feed material flows from the prehydrolysis reactor vessel to the inlet of the Kraft cooking vessel, wherein the interior of the Kraft cooking vessel maintains the feed material in an alkaline environment, and the Kraft cooking vessel has a high pressure discharge outlet from which the feed material is discharged as pulp.

DETAILED DESCRIPTION OF THE INVENTION

Figure 1:
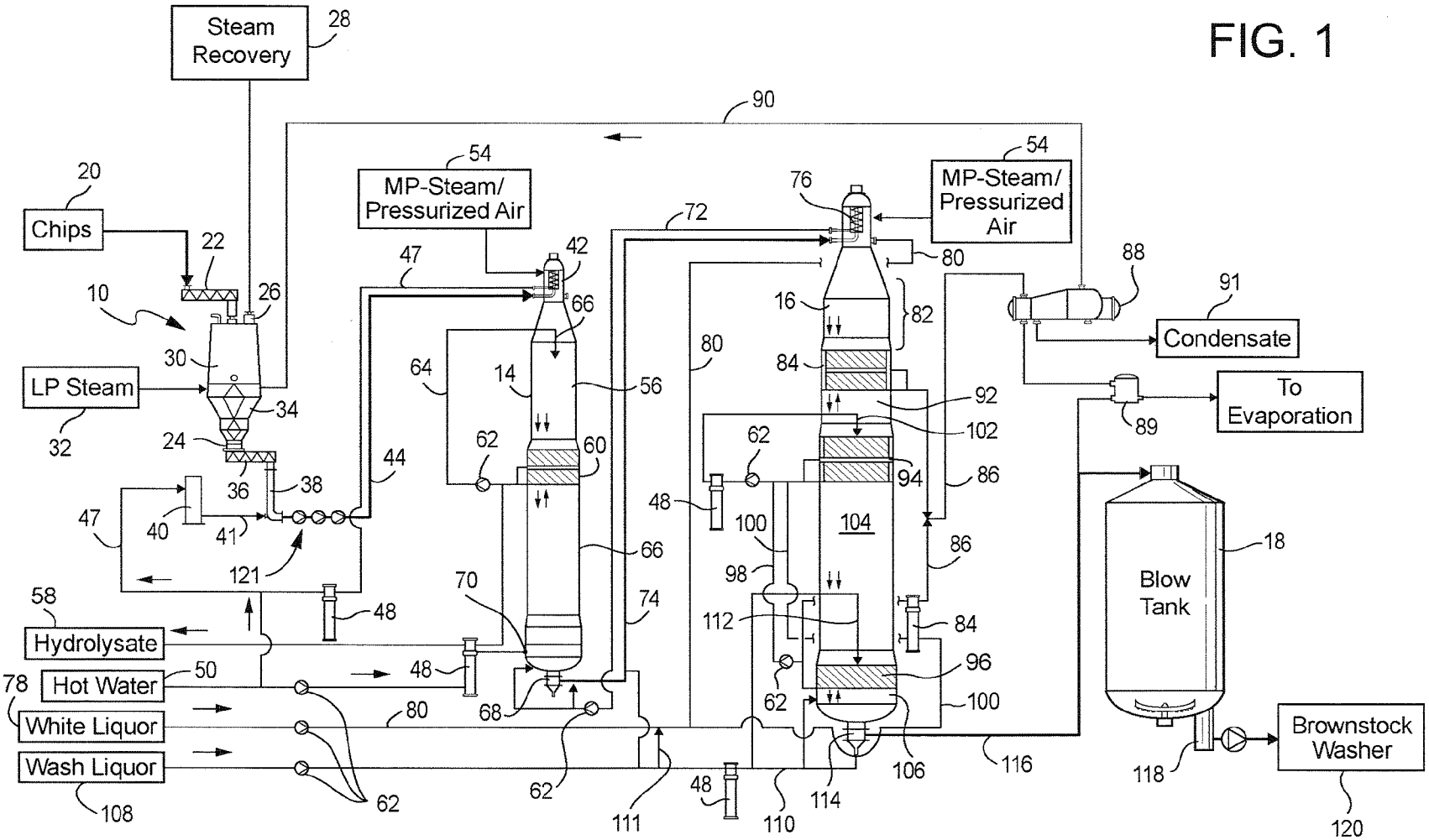
FIG. 1 is a process flow diagram of a Kraft cooking system for dissolving pulp.

FIG. 1 is a process flow diagram of a system for dissolving pulp using pre-hydrolysis and Kraft cooking. The system includes a steaming chip bin 10, a high pressure transport device 12, a pressurized pre-hydrolysis reactor vessel 14, a pressurized Kraft cooking reactor vessel 16 and a blow tank 18. The cellulosic feed material may flow continuously through the system. The amount of feed material flowing through the system depends on the size of the system, and this amount may be in excess of 500 to 3,500 tons per day. The system may be used to dissolve pulp for the production of, for example, rayon, plastics and biofuels, such as ethanol.

Cellulosic feed material 20 is fed by a chip feeder 22 to an upper inlet of the chip bin 10. The cellulosic feed material may be wood chips, biomass, comminuted lignocellulosic material and other organic fibrous material. The chip feeder 22 may be screw conveyor or tube that provides an air lock to seal the interior chamber of the chip bin 10 from the atmosphere. The chip feeder may include a metering screw to regulate the amount of feed material continuously entering the upper inlet of the chip bin.

The chip bin 10 may be a vertical vessel with a bottom discharge 24. A vent 26 at the top of the chip bin 10 allows steam and other vapors to exhaust from the chip bin to a steam or vapor recovery system 28. The addition of steam 32 to the chip bin allows for presteaming of the chips in the bin. The presteaming is believed to initiate hydrolysis and release organic acids from the feed material. These organic acids tend to be slightly acidic and, thus, assist in establishing a slightly acidic environment for the feed material.

The chip bin 10 may include an upper chamber 30 that has a circular or elliptical cross-section and a diameter of, for example, about 10 to 15 feet (3 to 5 meters). The height of the upper chamber may be one-half to two-thirds the entire height of the chip bin. Low pressure steam 32, e.g., 10 to 20 psig, may be added to a lower region of the upper chamber of the chip bin. The steam heats the feed material in the chip bin to a temperature of, for example, about 100 degrees Celsius.

The lower chamber 34 of the chip bin has an upper region continuous with the bottom of the upper chamber 30. The geometry, e.g., cross-sectional geometry, of the lower chamber 34 may have a substantially circular cross-section open top and a substantially rectangular cross-section open bottom discharge 24. The lower chamber may have opposite sidewalls which are not vertical and gradually tapering planar walls. Between the opposite planar side walls, are opposite curved side walls connecting the planar side walls. The planar side walls may each be generally triangular in plan view. These planar sidewalls may be arranged vertically in a diamond shape. The Diamondback® chip bin sold by the Andritz Group is an example of the chip bin described herein.

The retention period of the feed material in the chip bin 10 may be relatively brief, such as 15 or 25 minutes or longer. The feed material moves from the bottom discharge 24 of the chip bin to a generally horizontal screw conveyor 36, such as a twin-screw conveyor, which includes a helical screw in a cylindrical housing. The conveyor 36 may be oriented at a slight incline such as of no more than ten degrees. The inclined screw conveyor is at a higher elevation at the bottom discharge 24 and at a lower elevation at the end of the screw conveyor which connects to a vertical chip tube 38.

The chip tube is at least partially filled with liquid, such as hot water 50 and liquid extracted from the inverted top separator 42 of the pre-hydrolysis vessel 14. The liquid is temporarily stored in a tank 40 and flows via conduit line 41 to the chip tube 38 under the hydraulic pressure created in the tank 40.

The chip tube 38 may be filled with feed material, hot water and other liquids. The hydraulic pressure at the bottom of the chip tube ensures that the feed material is fed to the inlet to the high pressure transport device 12. The hot water and other liquids may have a neutral or slightly acidic pH. Adding the hot water and other liquids to the feed material in the chip tube may reduce the overall pH of the mixture and thereby reduce the tendency to have a strongly acidic pH in the upper region of the pre-hydrolysis reactor vessel 14.

The high pressure in the transport device 12 provides the force to move the feed material up to the top separator 42 at the top of the pre-hydrolysis reactor 14 and to increase the pressure of the feed material to substantially above atmospheric pressure. The transport device 12 may be one or more centrifugal pumps arranged in series, such as in the Turbofeed® sold by the Andritz Group. The transport device may also be a sluicing, pocketed rotor. The feed material and liquid moves from the high pressure transport device 12 via line 44 to the inverted top separator 42 in an upper region of the pre-hydrolysis reactor vessel 12.

In the chip bin and elsewhere in the feed system, the pH of the feed material may be controlled by extracting acidic liquor from the feed material though an in-line drainer(s), such as in the discharge assembly for the chip bin and at the chip tube. Further, the pH may be maintained mildly acidic by adding neutral wash liquid (or wash liquid with a bisulfite compound) through dilution nozzles arranged in a lower region of the chip bin and at the bottom of the chip tube.

The retention period of the feed material in the prehydrolysis reactor vessel may be over an hour, such as 100 minutes. The pre-hydrolysis reactor vessel 14 is shown more clearly in FIG. 2. The vessel 14 may be a pressurized, vapor phase reactor vessel having a vertical or inclined orientation, and a height or length in excess of 20 meters. Alternatively, the vessel 14 may be a hydraulic vessel having a heating circulation flow to heat the feed material to a desired prehydrolysis temperature.

The inverted top separator 42 is mounted in the upper region 45 of the interior of the vessel 14. The upper region 45 may be a vapor phase region. As the feed material flows to the bottom of the top separator 42, a helical conveyor 46 moves the material through the top of the separator. The feed material is discharged from the top of the top separator 42, and falls through the vapor phase to an upper surface 48 of the liquid and chip column in the vessel 14.

Liquor (liquid) may be extracted in the top separator from the feed material through a screen around the helical conveyor 46 and into a line 47 that conveys the extracted liquor through a heat exchanger 48 (FIG. 1) to the tank 40 for the high pressure transport device. The ratio of liquor to chip (liquor to feed material) tends to be higher for transport than in the pre-hydrolysis reactor vessel 14. Accordingly, a portion of the liquor extracted from the inverted top separator 42 may be added to the feed material in the chip tube 36.

Medium pressure steam 54, e.g., having a 180 to 200 psig and a neutral pH level, may be added as the feed material enters the pre-hydrolysis vessel 14, such as while the feed material is in the top separator or as the feed material falls through the vapor phase region 44. The medium pressure steam or pressurized air 54 (or both and an inert gas) is added to the top of the pre-hydrolysis vessel 14 to create a pressure and temperature environment in the vessel to promote hydrolysis. The prehydrolysis reactor vessel 14 may be controlled based on either or both the pressure and temperature in the vessel. Pressure control may be by use of a controlled flow of the steam or air 54. The steam temperature may be approximately 170 degrees Celsius to raise the temperature of the feed material in the vessel 14 to above the autohydrolysis temperature which may be above 140 degrees Celsius, such as 150 or 165 degrees Celsius.

After reaching the surface of the chip and liquor column 48 in the prehydrolysis vessel, the feed material gradually flows down through the prehydrolysis reactor vessel 14. As the feed material moves down through the vessel, new feed material and liquor liquid are continuously added to the surface 48 from the top separator. The chip and liquor column in the vessel is maintained at a pressure and temperature to promote hydrolysis. The temperature and pressure in the vessel may be monitored by sensors.

Hydrolysis occurs in a hydrolysis zone 56 of the prehydrolysis reactor vessel 14, where the temperature is maintained at or above the normal hydrolysis temperature. By controlling the temperature of the feed material in the zone 56, to for example between 140 and 175 degrees Celsius, autohydrolysis will occur due to organic acids released from the feed material. As an alternative to autohydrolysis, the hydrolysis temperature in the hydrolysis zone may be below 150 degrees Celsius, such as between 150 to 120 degrees Celsius, if mild acids are added to the feed material in the prehydrolysis. Mild acids may be an acid concentration of, or equivalent to, between 0.2 percent and 0.5 percent $H_2SO_4$.

Figure 2:
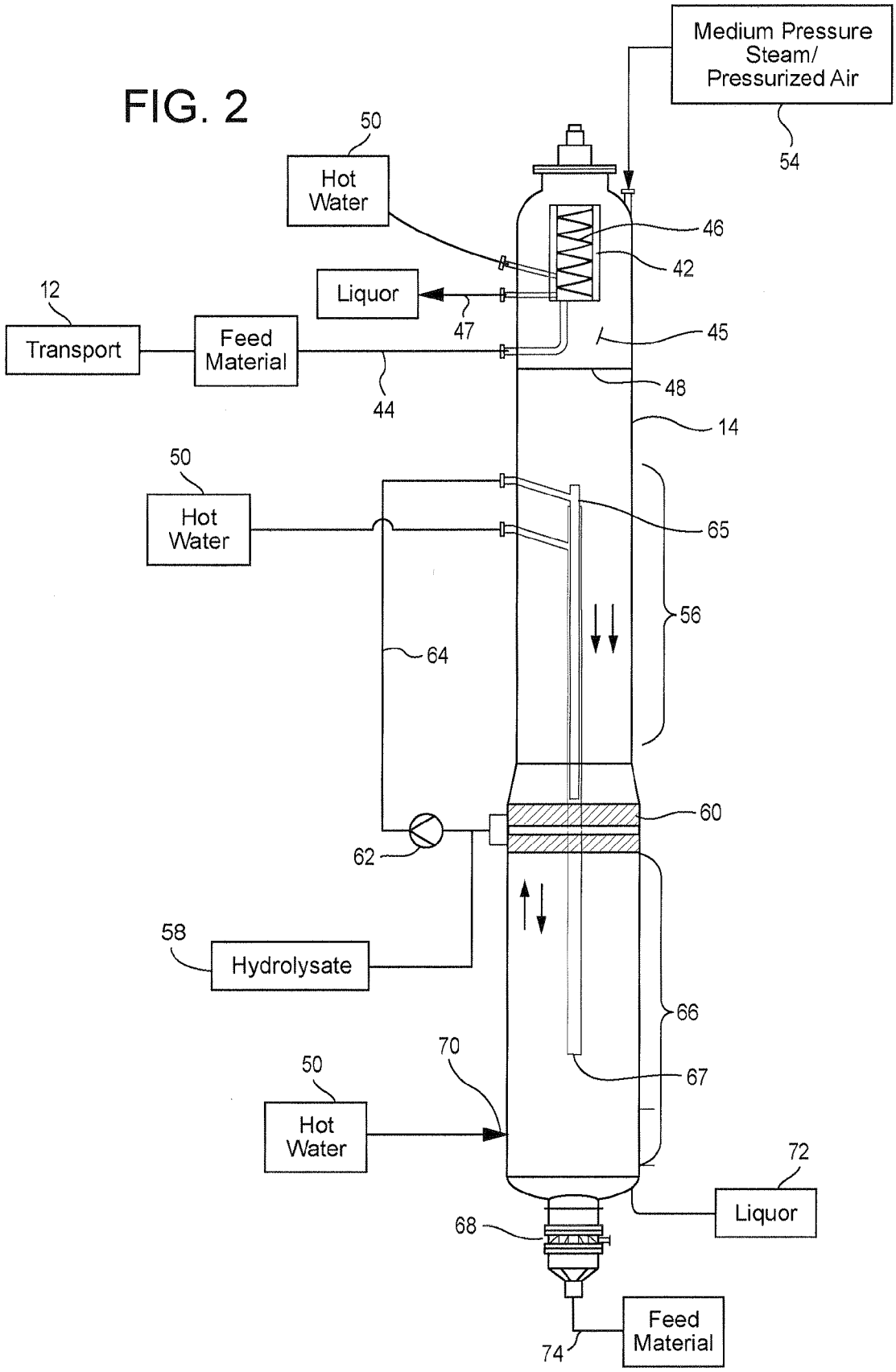
FIG. 2 is an enlarged view of the pre-hydrolysis reactor vessel shown in FIG. 1.

The feed material and liquor flow concurrently downward through the hydrolysis zone 56. The double downward arrows in FIG. 2 shown in the vessel 14 illustrate the concurrent flow.

Hydrolysate 58, e.g., pseudolignins, lignin fragments, and hemicellulose, is a product of hydrolysis. Hydrolysate is formed in the hydrolysis zone 56 and extracted through screens 60 immediately below the hydrolysis zone. The screen extracts hydrolysate, liquor and wash liquid in vessel at the elevation of the screens 60. The screens 60 extract the hydrolysate before the compounds in the hydrolysate, with a tendency to condense and precipitate, coats the pores of the feed material and builds up on internal surfaces of the vessel 14 and other equipment.

The hydrolysate may be recovered by extracting the heat from the hydrolysate to provide heat energy for the hot water used for washing the feed material in the prehydrolysis reactor, and for further processing. For example, the hydrolysate may be used to form biofuels, such as ethanol or may be processed to produce chemicals such as furfural.

The extracted liquor, including hydrolysate, may be pumped 62 via line 64 to a center pipe 65 coaxially mounted within the vessel 14. The center pipe 65 discharges the extracted liquor to an upper elevation of the hydrolysis zone to control the pH level in the zone 56, such as a pH of 4 or 3.5 or between 3 and 4 pH, and promote a uniformly mild acidic pH level throughout the zone 56. The extracted liquor may be added to the hydrolysis zone 56 at various elevations throughout the zone, especially towards the upper regions of the zone. The hydrolysis zone may vary in height and may be one-half to two-thirds the height of the vessel 14.

A wash zone 66 in the prehydrolysis reactor vessel 14 is below the screens 60 and extends downward to the discharge assembly 68. The wash zone may be the bottom one-third or less of the height of the vessel 14. Hot water 50 or other pH neutral wash liquid is added to the lower portion of the wash zone 66 through nozzles 70 mounted to the wall of the vessel 14 or through a bottom outlet 67 of the center pipe 65. The center pipe may have an internal vertical passage for the wash liquid and another passage for the extracted liquor.

The hot water 50 may be heated by a heat exchanger 48 with heat recovered by a portion of the extracted hydrolysate 58 which is not recirculated back to the prehydrolysis vessel 14. The temperature of the hot water is below the hydrolysis temperature in the hydrolysis zone, such as a temperature between 110 to 160 degrees Celsius. The hot water may flow upwards through the wash zone 66 in a counter-current direction to the downward flow of feed material. The counter-current flows increase the heat efficiency in the wash zone and reduce the consumption of water and steam in the wash zone. As the hot water flows up through the wash zone, the hydrolysate becomes entrained with the water and is extracted from the vessel 14 with the water through the screens 60.

The hot water may be fortified with a bisulfite compound or other additive(s) before being added as a wash liquid to the pre-hydrolysis reactor vessel. The bisulfite compound or other additive should reduce the tendency of the dissolved lignin or pseudo-lignin flowing with the feed material in the wash zone to precipitate on the surfaces of the chips and the prehydrolysis reactor vessel.

The temperature of the feed material in the wash zone 66 may be below the hydrolysis temperature, which corresponds to the temperature in the hydrolysis zone. The temperature of the feed material in the wash zone may be 10 to 40 degrees Celsius below the hydrolysis temperature. Reducing the feed material temperature in the wash zone and extracting acids from the feed material in the screens 60 may suppress and stop hydrolysis. Stopping hydrolysis in the wash zone should prevent further formation of hydrolysate as the feed material flows through the wash zone.

As the feed material reaches the bottom of the prehydrolysis reactor vessel 14, the material enters the discharge assembly 68 where dilution liquor 72 extracted from the Kraft cooking vessel, e.g., a continuous digester pressurized vessel, is added to increase the ratio of liquor to feed material and thereby assist in transporting the feed material via line 74 to a inverted top separator 76 in the upper region of the cooking vessel 16. The dilution liquor may be fortified with a bisulfite compound or other additive(s) before being added to the feed material at or near the discharge of the pre-hydrolysis reactor vessel. The bisulfite compound or other additive should reduce the tendency of the dissolved lignin or pseudo-lignin flowing with the feed material to precipitate on the surfaces of the chips and transfer devices.

The retention period of the feed material in the cooking vessel 16 may be about two hours. The feed material is in an alkaline condition, such as at or near a pH of 13, e.g., 12 to 14, and held at a temperature higher than in the prehydrolysis vessel such as at a temperature of 170 degrees Celsius. Further and for example, the feed material in the cooking vessel may be maintained in a range of 140 degrees and 175 degrees Celsius, or 150 degrees and 160 degrees Celsius, depending upon the retention time in the vessel, the alkali concentration in the cooking vessel, and the desired lignin content of the final pulp product from the cooking vessel 16.

In one mode of operation, the feed material is in a slightly acidic condition as it moves from the prehydrolysis reactor vessel 14 to the cooking vessel 16. The acidic condition of the feed material is maintained as the feed material enters the inverted top separator 76. The feed material is made alkaline by adding alkaline white liquor 78 via line 80 to the top separator or the upper region of the cooking vessel. The addition of white liquor may be controlled to avoid having substantial amounts of white liquor extracted through the separator 76 and flow through line 72 to the discharge assembly of the prehydrolysis reactor vessel 14. Excessive amounts of white liquor being added prematurely to the feed material may cause the feed material to become alkaline before entering the cooking vessel 16. In another mode of operation, the transfer circulation is made alkaline by the addition of white liquor and the pH is raised as the chips are transported from the prehydrolysis reactor vessel 14 to the cooking vessel 16.

The temperature in the cooking vessel 16 is elevated and controlled by the addition of medium pressure steam 54 and possibly air or an inert gas. The cooking vessel may be a vapor phase or hydraulic phase vessel operated at a pressure in balance with the pressure in the prehydrolysis reactor vessel 14. The pressure at the bottom of the prehydrolysis reactor vessel is a combination of the medium steam pressure and the hydraulic pressure of the chip and liquid column in the vessel 14. This combined pressure is greater than the pressure at the top of the cooking vessel, which may be at the pressure of the medium pressure steam 54. The pressure differential between the bottom of the prehydrolysis reactor vessel and the top of the cooking vessel moves the feed material between through line 74. Further and where a hydraulic digester cooking vessel is used, a heating circulation may be used to heat the feed material to the desired cooking temperature.

The cooking vessel 16 may have multiple zones of concurrent and counter-current flow. An upper cooking zone 82 may have concurrent flow of the feed material and liquor. A portion of the black liquor is extracted through screens 84 at the bottom of the upper cooking zone. The extracted black liquor flows through line 86 to provide heat energy for a reboiler 88. Clean low pressure steam generated in the reboiler flows via line 90 to provide heat energy to the chip bin 10. Condensate 91 from the reboiler may be used as hot water 50. The black liquor flows from the reboiler to a black liquor filter 89. The filtered liquor flows to weak black liquor tanks for further processing in the black liquor evaporation system. The rejects from the black liquor filter, which contain fiber and un-cooked raw material fragments, flow to the blow tank. Other heat recovery systems that recover heat from the hot black liquor, such as flash tanks and heat exchangers, may be used with or in substitution for the reboiler 88.

In a middle cooking zone 92, the feed material continues to move downward and a counter-current flow of black liquor flows up through the zone 92, as indicated by the opposing arrows. Additional liquor is extracted through screen(s) 94. The black liquor extracted from screen(s) 94 is combined with black liquor extracted from a lower screen 96 flowing through line 98. White liquor 78 and wash liquor 108 (line 111) may be added to the combined black liquor flow via line 100. The combined flows of black liquor and white liquor are recirculated to the cook vessel via a center pipe 102 that adds the combined fluid at or below the screens 94.

The rate at which the combined flow is added through the center pipe 102 and the rates at which liquor is extracted through screens 84 and 92 are adjusted such that liquor flows upward through the middle cooking zone and downward through a lower cooking zone 104. The lower cooking zone may have a length of zone-third, one-half or more of the vertical length of the digester vessel 16.

A wash zone 106 at the bottom of the cooking vessel washes the feed material to extract black liquor. Wash liquor 108 flows through a wash line 110 to the lower region of the wash zone and through a center pipe 112 to the wash zone. As the wash liquor flows up through the wash zone, the black liquor and other chemicals in the feed material are entrained, flow upwards and are extracted through the screen 96.

A bottom discharge assembly 114 discharges the washed feed material from the cooking vessel via line 116 to the blow tank 18. The pressure of the feed material is released in the blow tank. From the discharge 118 of the blow tank, the feed material, which is now dissolved pulp, is pumped to further processing such as a brown stock washer 120.

The process described herein for producing dissolved pulp using pre-hydrolysis and Kraft cooking maintains a slightly acidic pH for prehydrolysis, extracts the hydrolysate promptly after its generation, and ensures quick transition to alkaline conditions in the cooking vessel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The claimed invention is:

1. A method to produce pulp using a feed system, a prehydrolysis reactor vessel and Kraft cooking vessel, the method comprising:

steaming cellulosic fibrous organic feed material in a material feed system;

adding to the feed material liquor extracted from the prehydrolysis reactor vessel before the feed material enters the prehydrolysis reactor vessel;

pressurizing the feed material from the chip feed system in a high pressure transfer device before the feed material enters the prehydrolysis vessel and transferring the pressurized feed material to an upper inlet to the prehydrolysis reactor vessel;

subjecting the feed material to a hydrolysis reaction in a hydrolysis zone in the prehydrolysis reactor vessel, the feed material and a liquor flow concurrently in the hydrolysis zone, wherein hydrolysate is generated by the hydrolysis reaction;

extracting a hydrolysate-containing liquor through a screen in the prehydrolysis reactor vessel into a conduit, wherein the screen is adjacent a lower portion of the hydrolysis zone;

separating the extracted hydrolysate-containing liquor into at least a first portion and a second portion by forming at least a first flow path and a second flow path in the conduit;

discharging the first portion of the extracted hydrolysate-containing liquor in the first flow path from the prehydrolysis reactor vessel such that the discharged first portion does not return to the prehydrolysis reactor vessel;

returning the second portion of the extracted hydrolysate-containing liquor in the second flow path to one or more elevations of the hydrolysis zone upstream of the screen;

adding a wash liquid to a wash zone in the prehydrolysis reactor vessel;

as the feed material flows downward past the screen and through the wash zone, washing the feed material with the wash liquid flowing upward through the wash zone to the screen;

discharging the washed feed material from the prehydrolysis reactor vessel and transporting the washed feed material to an upper inlet to the Kraft cooking vessel;

changing the pH of the washed feed material to alkaline after the feed material is in the Kraft cooking vessel, and Kraft cooking the washed feed material in the Kraft cooking vessel to produce the pulp;

wherein the steps of the method are performed continuously and simultaneously as the feed material flows through the feed system, prehydrolysis reactor vessel and Kraft cooking vessel.

2. The method of claim 1 further comprising discharging the pulp from the Kraft cooking vessel to a blow tank, and discharging the pulp from the blow tank to a brown stock washer.

3. The method of claim 1 wherein the step of pressurizing the feed material includes pumping the feed material through at least one centrifugal pump, which comprises the high pressure transfer device.

4. The method of claim 1 wherein the step of adding the wash liquid includes injecting the wash liquid from a center pipe coaxial to the prehydrolysis reactor vessel and having a discharge port at a lower region of the wash zone.

5. The method of claim 1 wherein the hydrolysis reaction is an autohydrolysis reaction and a temperature in the feed material is between 150 degrees and 175 degrees Celsius.

6. The method of claim 1 wherein the pH of the pressurized feed material in the hydrolysis zone is maintained at a pH in a range of 3 to 4.

7. The method of claim 6 wherein the pH is maintained at a pH of 4.

8. The method of claim 1 wherein the wash liquid enters the wash zone at a temperature at least 10 degrees Celsius below a hydrolysis temperature in the hydrolysis zone.

9. The method of claim 1 wherein the wash liquid includes a bisulfite compound.

10. The method of claim 1 wherein wash filtrate or liquor extracted from the feed material at a first elevation of the prehydrolysis reactor vessel is reintroduced to the feed material in the prehydrolysis reactor vessel at a second elevation which is above the first elevation.

11. The method of claim 1 wherein alkaline white liquor is added to the feed material as the feed material is in an upper region of the Kraft cooking vessel.

12. The method of claim 1 wherein alkaline white liquor is added to the feed material as the feed material is in a transfer line between the prehydrolysis reactor vessel and the Kraft cooking vessel.

13. The method of claim 1 wherein the extracted hydrolysate-containing liquor is returned directly to an upper portion of the hydrolysis zone upstream of the screen, the liquor is returned to a portion of the hydrolysis zone after the feed material has entered the prehydrolysis reactor vessel.

14. The method of claim 1, wherein the pressuring of the feed material occurs downstream of the addition of the prehydrolysis liquor to the feed material.

15. A method for pulping a comminuted cellulosic fibrous organic feed material in a feed system, a prehydrolysis reactor vessel and Kraft cooking vessel, the method comprising:

steaming and adding filtrate to the feed material as the feed material flows continuously through the material feed system, wherein the filtrate is extracted from the prehydrolysis reactor;

pressurizing the feed material flowing from the chip feed system in a high pressure transfer device;

moving the pressurized feed material into the prehydrolysis reactor vessel;

subjecting the feed material to a hydrolysis reaction in a hydrolysis zone in the prehydrolysis reactor vessel, the feed material and a liquor flow concurrently in the hydrolysis zone;

extracting a hydrolysate-containing liquor formed in the hydrolysis zone and the wash filtrate through a screen proximate to a lower region of the hydrolysis zone in the prehydrolysis reactor vessel, the hydrolysate-containing liquor is extracted into a conduit;

separating the extracted hydrolysate-containing liquor into at least a first portion and a second portion by forming at least a first flow path and a second flow path in the conduit;

discharging the first portion of the extracted hydrolysate-containing liquor in the first flow path such that the extracted first portion does not return to the prehydrolysis reactor vessel;

returning the second portion of the extracted hydrolysate-containing liquor in the second flow path to one or more elevations of the hydrolysis zone upstream of the screen;

adding a wash liquid to a wash zone in the prehydrolysis reactor vessel, wherein the wash zone is below the hydrolysis zone in the prehydrolysis reactor;

moving the feed material continually downward through the hydrolysis zone and the wash zone of the prehydrolysis reactor vessel;

moving the wash liquid continually upward through the wash zone to the screen;

discharging the feed material from a lower outlet of the prehydrolysis reactor vessel, wherein the lower outlet proximate to a bottom of the wash zone;

moving the discharged feed material into the Kraft cooking vessel;

adjusting the pH of the discharged feed material to alkaline while the feed material is in the Kraft cooking vessel, and cooking the feed material in the Kraft cooking vessel to produce pulp;

wherein the steps of the method are performed contentiously continuously and simultaneously as the feed material flows through the feed system, high pressure feeder, prehydrolysis reactor vessel and Kraft cooking vessel.

16. The method of claim 15 further comprising discharging the pulp from the Kraft cooking vessel to a blow tank, and discharging the pulp from the blow tank to a brown stock washer.

17. The method of claim 15 wherein the hydrolysis reaction is an autohydrolysis reaction and a temperature in the feed material is between 150 degrees and 175 degrees Celsius.

18. The method of claim 15 wherein the pH of the pressurized feed material in the hydrolysis zone is maintained at a pH of between 3 and 4.

19. The method of claim 18 wherein the pH is maintained at a pH of 3.5 to 4.

20. The method of claim 15 wherein the wash liquid enters the wash zone at a temperature at least 10 degrees Celsius below a hydrolysis temperature in the hydrolysis zone.

21. The method of claim 15 wherein the wash liquid includes a bisulfite compound when added to the wash zone.

22. The method of claim 15 wherein wash filtrate or liquor extracted from the feed material at a first elevation in the prehydrolysis reactor vessel is reintroduced to the feed material in the prehydrolysis reactor vessel at a second elevation which is above the first elevation.

23. The method of claim 15 wherein alkaline white liquor is added to the feed material as the feed material is in an upper region of the Kraft cooking vessel.

24. The method of claim 15 the extracted hydrolysate-containing liquor is returned directly to an upper portion of the hydrolysis zone upstream of the screen, the liquor is returned to a portion of the hydrolysis zone after the feed material has entered the prehydrolysis reactor vessel.

25. The method of claim 15, wherein the pressuring of the feed material occurs downstream of the addition of the wash filtrate to the feed material.

* * * * *